US011939844B2

(12) United States Patent
Guidry, Jr. et al.

(10) Patent No.: US 11,939,844 B2
(45) Date of Patent: Mar. 26, 2024

(54) ROTOR BEARING SYSTEM

(71) Applicant: NATIONAL OILWELL VARCO, L.P., Houston, TX (US)

(72) Inventors: Michael J. Guidry, Jr., Hockley, TX (US); Daniel Alvarado, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 17/814,326

(22) Filed: Jul. 22, 2022

(65) Prior Publication Data

US 2024/0026738 A1 Jan. 25, 2024

(51) Int. Cl.
*E21B 4/02* (2006.01)
*E21B 4/00* (2006.01)

(52) U.S. Cl.
CPC ..... *E21B 4/003* (2013.01); *E21B 4/02* (2013.01)

(58) Field of Classification Search
CPC ..... E21B 4/02; E21B 4/003
See application file for complete search history.

(56) References Cited

U.S. PATENT DOCUMENTS

| | | | | |
|---|---|---|---|---|
| 7,445,061 | B1 * | 11/2008 | Falgout, Sr. | E21B 4/003 175/106 |
| 9,334,691 | B2 | 5/2016 | Jarvis et al. | |
| 9,482,223 | B2 | 11/2016 | Jarvis et al. | |
| 2009/0044409 | A1 * | 2/2009 | Gynz-Rekowski | B21D 53/10 384/129 |
| 2013/0048384 | A1 * | 2/2013 | Jarvis | F04C 2/1071 175/57 |
| 2013/0319764 | A1 * | 12/2013 | Schaaf | E21B 7/068 175/50 |
| 2014/0332275 | A1 * | 11/2014 | Murray | F01C 1/10 175/57 |
| 2016/0208556 | A1 * | 7/2016 | Gawski | E21B 4/02 |
| 2021/0363826 | A1 * | 11/2021 | Powell | F03B 13/02 |

* cited by examiner

*Primary Examiner* — Giovanna Wright
(74) *Attorney, Agent, or Firm* — Schwegman Lundberg & Woessner, P.A.

(57) ABSTRACT

A rotor bearing system configured to operatively couple a progressing cavity machine to an external device can comprise a housing including an inner surface defining a first bore extending through the housing along a central axis, a first bearing arranged on the inner surface, and a shaft member including an outer surface extending between a proximal portion and a distal portion of the shaft member and a second bearing arranged on the outer surface, the second bearing the second bearing configured to contact the first bearing to limit eccentric motion of the driveshaft of the external device and the rotor head of the progressing cavity machine relative to a stator of the progressing cavity machine during rotation of the rotor head, the shaft member, and the driveshaft.

18 Claims, 6 Drawing Sheets

ROTOR BEARING SYSTEM

TECHNICAL FIELD

This document pertains generally, but not by way of limitation, to progressing cavity machines and external devices connectable thereto. More particularly, but not by way of limitation, this document pertains to systems and methods for limiting, resisting, and/or controlling eccentric motion of a rotor head of a progressing cavity machine relative to a driveshaft of an external device coupled to the rotor.

BACKGROUND

Moineau-type progressing cavity machines are in widespread use for many different applications in a variety of industries. For example, progressive cavity machines are often used to pump high viscosity fluids, to pump abrasive fluids containing solid masses or particulates, or to pump fluid in Net Positive Suction Head (NPSH) conditions, such as when lifting fluid from subterranean aquafers or other natural or artificial reservoirs. Progressive cavity machines are also frequently used as a motor to provide rotational drive to various external devices, such as drilling assemblies, milling machines, agitating equipment, or other types of machinery. A progressive cavity machine generally includes a stationary stator defining a plurality of stator lobes including a sealing material; and a rotatable rotor defining a plurality of rotor lobes corresponding in shape and size to the stator lobes. During rotation of the rotor within the stator, surfaces of the stator lobes and surfaces of the rotor lobes contact one another to form seal lines which create progressing cavities. These progressing cavities move in a spiral pattern relative to one another, while concurrently progressing in a linear fashion from one end of the progressive cavity machine to another.

The rotor of a progressive cavity machine can be rotatably driven based on a configuration of the progressive cavity machine. For example, if the progressive cavity machine is configured to pump fluid, the progressive cavity machine can include a motor operable to rotate the rotor, such as to cause fluid to be drawn into, and move through, the stator. If the progressive cavity machine is configured to rotate a driveshaft to provide rotational drive to an external device, the progressive cavity machine can include, or be in fluid communication with, a fluid system, such as operable to pump pressurized fluid into the stator to force the rotor, and a driveshaft of the external device coupled thereto, to rotate. In the field of wellbore drilling for fossil fuel extraction, progressive cavity machines are commonly used as motors to provide rotational drive to a drilling assembly of a drill string extending into a subterranean formation. For example, an end of the driveshaft of the drilling assembly can be secured to a rotor head of the rotor of the progressing cavity machine. A fluid system, such as located at or above ground level, can then pump pressurized fluid through the drill string and the progressive cavity machine to cause the driveshaft to rotate, such as to in turn rotate a drill bit of the drilling assembly in contact with the subterranean formation.

However, during a wellbore drilling operation, the rotating mass of the end of the driveshaft and the rotor head can apply large dynamic and static radial loads to the sealing material deposited on the stator lobes located near the rotor head stemming from eccentric motion of the rotor head relative to the end of the driveshaft. This can cause the sealing material to wear down quickly, leading to failure of the seal lines formed between surfaces of the rotor lobes and the sealing material deposited on surfaces of the stator lobes. For example, erosion of the sealing material can progressively reduce the efficiency and power output (e.g., available output torque or maximum rotor speed) of the progressing cavity machine, which can delay or otherwise slow a wellbore drilling operation. Eventually, the sealing material will erode to a point rendering the progressing cavity machine inoperable, halting further drilling progress and requiring costly and time-consuming removal and replacement of the progressing drilling machine.

Overview

The present disclosure can help to address the above issues, among others, such as by providing a rotor bearing system configured to operatively couple a progressing cavity machine to a driveshaft of an external device, such as a drilling assembly for use in wellbore drilling operations. First, for example, the rotor bearing system can include a shaft member configured to connect, such as by extending between, a rotor head of the progressing cavity machine directly to an end of a driveshaft of a drilling assembly. The shaft member can be supported between a first bearing extending radially inward from a housing encompassing the shaft member and a second bearing extending radially outward from an outer surface of the shaft member. The first bearing and the second bearing can contact and engage each another during rotation of the shaft member to limit eccentric motion of the shaft member relative to the housing, to, in turn, limit eccentric motion of the end of the driveshaft relative to the rotor head when the shaft member is connected to the end of the driveshaft and the rotor head. In view of the above, the rotor bearing system can increase the lifespan of a progressing cavity pump by decreasing the static and dynamic loads the sealing material deposited on the stator lobes near the rotor head is subject to during rotation of the rotor.

Second, in some examples, the rotor bearing system can be a standalone device connectable to various commercially available progressing cavity machines, drilling assemblies, or other external devices including a driveshaft. For example, the housing of the rotor bearing system can define a first connecting feature, such as configured to engage a stator of an existing progressive cavity machine, and a second connecting feature, such as configured to engage a driveshaft housing of an existing drilling assembly. This can reduce the cost of implementing a system or method to limit eccentric motion of a rotor head of a progressing cavity machine, such as by eliminating the need to modify a progressing cavity machine, a drilling assembly, or other external devices connectable to a progressing cavity machine to include any additional components.

A rotor bearing system configured to operatively couple a progressing cavity machine to an external device can comprise: a housing including: an inner surface defining a first bore extending through the housing along a central axis; a first bearing extending radially inward from the inner surface into the first bore; and a shaft member configured to connect a driveshaft of the external device to a rotor head of the progressive cavity machine, the shaft member including: an outer surface extending between a proximal portion and a distal portion of the shaft member; and a second bearing extending radially outward from the outer surface, the second bearing configured to contact the first bearing to limit eccentric motion of the driveshaft of the external device and the rotor head of the progressing cavity machine relative to a stator of the progressing cavity machine during rotation of the rotor head, the shaft member, and the driveshaft.

A progressing cavity machine configured to provide rotational drive to an external device can comprise: a housing comprising: a stator portion and a bearing portion collectively defining an outer surface, the stator portion including an inner surface defining a plurality of internal lobes and the bearing portion including an inner surface defining a first bearing; and a shaft member comprising: a rotor portion including: an outer surface defining a plurality of external lobes configured to form a plurality of progressing cavities via contact with the plurality of internal lobes during rotation of the shaft member; and a cylindrical portion including: a coupler configured to engage a driveshaft of the external device to secure a rotor head of the shaft member to the driveshaft; and a second bearing arranged on an outer surface of the cylindrical portion, the second bearing configured to contact the first bearing to limit eccentric motion of the driveshaft of the external device and the rotor head of the progressing cavity machine relative to the stator portion of the progressing cavity machine during rotation of the rotor head, the shaft member, and the driveshaft.

A method of limiting eccentric motion of a rotor head of a progressing cavity, machine and a driveshaft of an external device relative to a stator of the progressing cavity machine using a rotor bearing system can comprise: securing a proximal portion of a shaft member of the rotor bearing system to the rotor head of the progressing cavity machine; and securing a distal portion of the shaft member of the rotor bearing system of the rotor bearing system to the driveshaft of the external device.

This overview is intended to provide a summary of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
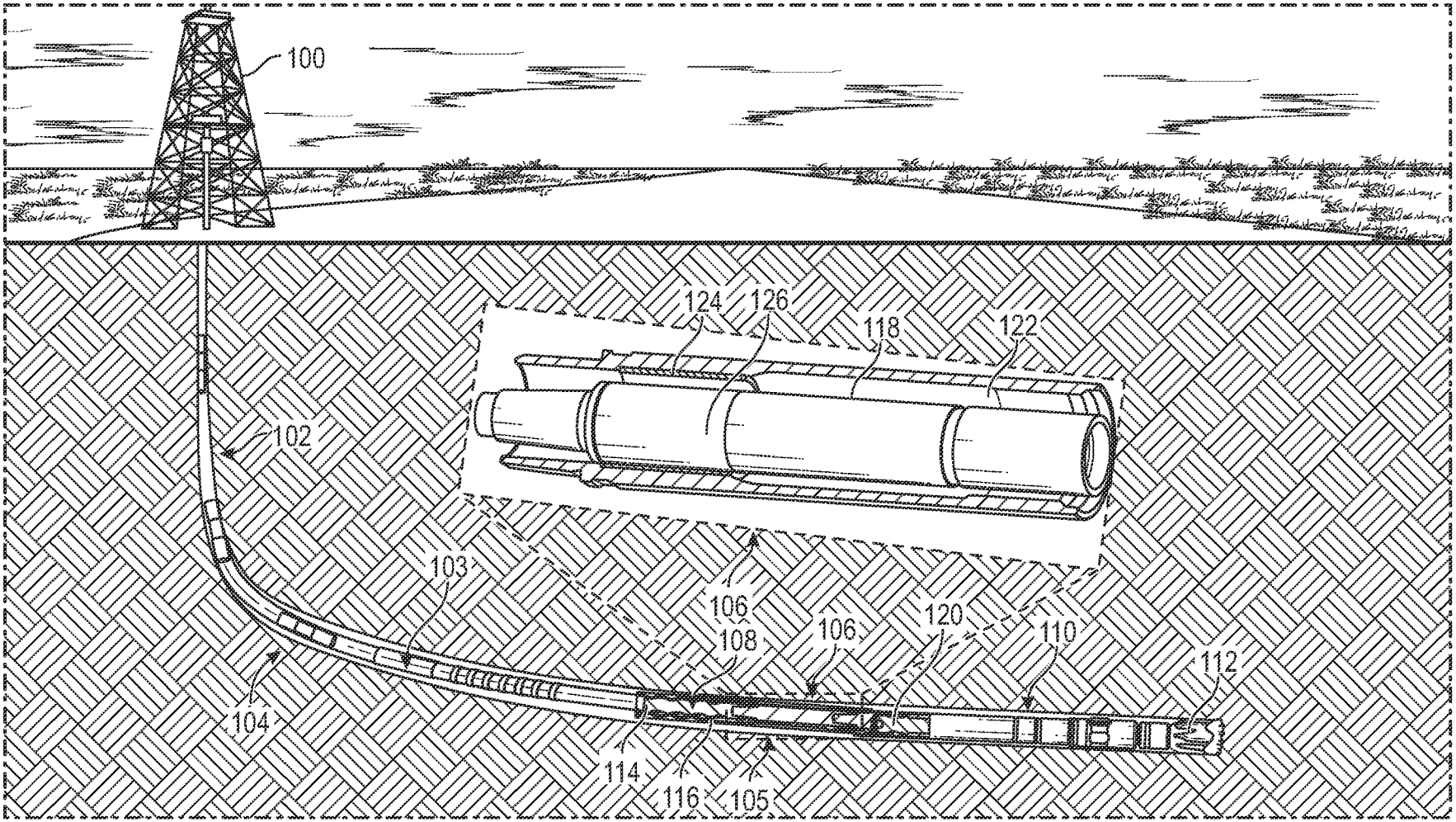
FIG. 1 illustrates a cross-section view of a drilling rig drilling a wellbore with a drill string including a rotor bearing system.

FIG. 1 illustrates a cross-section view of a drilling rig 100 drilling a wellbore 102 with a drill string 104 including a rotor bearing system 106. The drilling rig 100 can include a mast, a drill floor, and a variety of pipe handling equipment adapted to connect lengths of drill pipe, drill stands, or tubulars end-to-end to feed the drill string 104 into the wellbore 102. Such pipe handling equipment can include, for example, a top drive, an iron roughneck, one or more pipe elevators, drill floor slips, a racking board, and other equipment usable to manage drilling or tripping operations. The drill string 104 can include a series of drill pipes 103 connected end-to-end extending downward from the drilling rig 100 into the wellbore 102. The drilling rig 100 can include a fluid system for pumping drilling fluid into and through the drill string 104, such as to operate equipment of a bottom hole assembly 105 of the drill string 104. The fluid system can also include a recovery portion for capturing and cleaning drilling fluid within the wellbore 102, and a return portion for returning captured and cleaned drilling fluid back into the wellbore 102 for reuse.

The bottom hole assembly 105 can include the rotor bearing system 106, a progressing cavity machine 108, a drilling assembly 110 including a drill bit 112, a steering system, one or more measuring devices, or other equipment. The progressing cavity machine 108 and the drilling assembly 110 can represent various styles or types of progressing cavity machines or drilling assemblies, respectively. Drilling fluid can be pumped under pressure from the drilling rig 100 into the progressing cavity machine 108 through the drill pipes 103 of the drill string 104. The progressing cavity machine 108 can include a rotor 114 and a stator 116. Fluid flowing into and through the stator 116 can cause the rotor 114 to rotate within the stator 116. The rotor bearing system 106 can operatively couple the progressing cavity machine 108 to the drilling assembly 110. For example, the rotor bearing system 106 can include a shaft member 118 configured to couple the rotor 114 of the progressing cavity machine 108 to a driveshaft 120 of the drilling assembly 110. The rotor 114 can thereby rotate the shaft member 118 to rotate the driveshaft 120 and the drill bit 112 operatively coupled thereto.

The rotor bearing system 106 can limit eccentric motion of the driveshaft 120. For example, the shaft member 118 can be supported within a housing 122 secured to the progressing cavity machine 108 and the drilling assembly 110. The housing 122 can include a first bearing 124 and a second bearing 126. The first bearing 124 can extend radially inward from or be arranged on an inner surface 128 of the housing 122; and the second bearing 126 can extend radially outward from or be arranged on an outer surface 130 of the shaft member 118. The second bearing 126 can be configured to contact the first bearing 124 to limit eccentric motion of the driveshaft 120 relative to the rotor 114 during rotation of the rotor 114, the shaft member 118, and the driveshaft 120. Further, the housing 122 can be secured to both the stator and the drilling assembly 110 to prevent movement therebetween during drilling operations.

In the operation of some non-limiting examples, the bottom hole assembly 105 can be assembled. The progressing cavity machine 108 can be coupled to the drill pipes 103 in fluid communication with the drilling rig 100, such as connected to a fluid system thereof. The shaft member 118 can be secured to the rotor 114 and the driveshaft 120 to transfer rotational drive from the rotor 114 to the driveshaft 120; and the housing 122 can be secured to the progressing cavity machine 108 and the drilling assembly 110 to prevent lateral movement therebetween. The drill string 104 can then be inserted into, or begin drilling, the wellbore 102. For example, the fluid system can pump pressurized drilling fluid into the progressing cavity machine 108 to force the rotor 114, the shaft member 118, and the driveshaft 120, and the drill bit 112 to rotate. During rotation of the rotor 114 and the driveshaft 120, the first bearing 124 and the second bearing 126 can contact one another to inhibit, resist, or control lateral movement of the shaft member 118 within the housing 122, to thereby enable the shaft member 118 to support the driveshaft 120 and a rotor head (e.g., an end) of the rotor 114. In view of the above, the rotor bearing system 106 can externally prolong the life of the progressing cavity machine 108 by reducing the dynamic and static radial loads applied to the stator 116 of the progressing cavity machine 108 by the rotor 114 of the progressing cavity machine 108.

Figure 2:
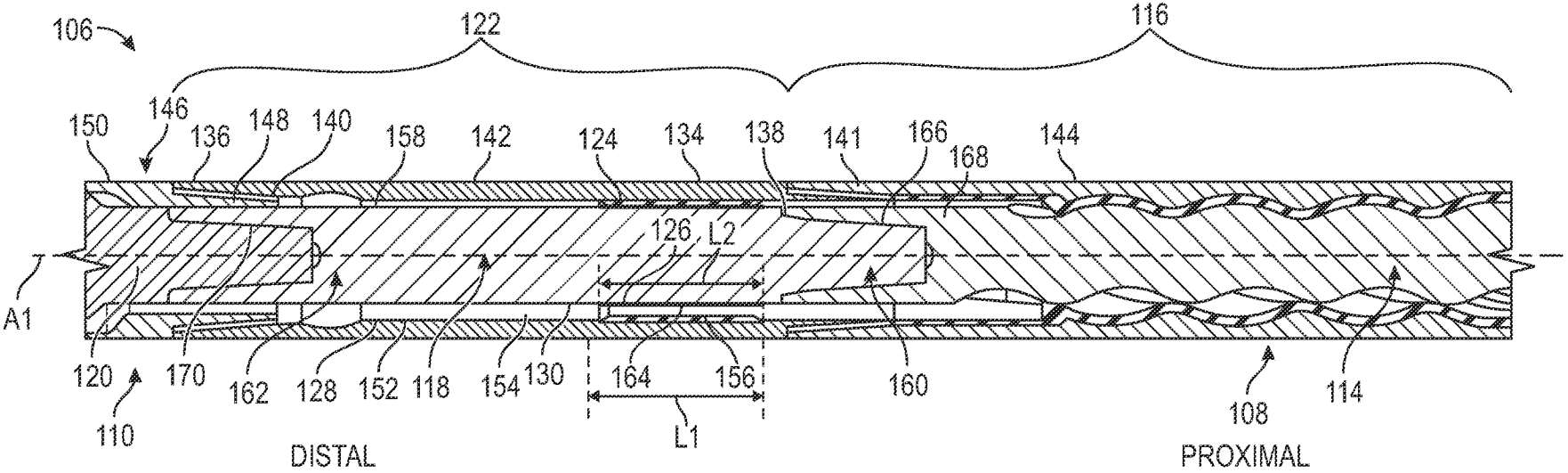
FIG. 2 illustrates a cross-section view of a rotor bearing system operatively coupling a progressing cavity machine to a drilling assembly.

FIG. 2 illustrates a cross-section view of a rotor bearing system 106 operatively coupling a progressing cavity machine 108 to a drilling assembly 110. Also shown in FIG. 2 is a central axis A1, and orientation indicators Proximal and Distal. FIG. 2 is discussed with reference to the rotor bearing system 106, the progressing cavity machine 108, and the drilling assembly 110 shown in FIG. 1 above. The housing 122 of the rotor bearing system 106 can include a first end 134 and a second end 136. The first end 134 and the second end 136 can be opposite portions or segments of the housing 122. The first end 134 can define a first connecting feature 138. The stator 116 of the progressing cavity machine 108 can include an end 141. The end 141 can be a proximal-most, relative to the housing 122, portion or segment of the stator 116. The first connecting feature 138 can be configured to engage the end 141 of the stator 116 to secure the housing 122 to the stator 116. For example, the first connecting feature 138 can be, but is not limited to, a first plurality of threads configured to threadedly engage a corresponding connecting feature, such as a plurality of threads defined by the end 141 of the stator 116.

The second end 136 of the housing 122 can define a second connecting feature 140. The drilling assembly 110 can include a driveshaft housing 146 defining an end 148. The end 148 can be a proximal-most, relative to the housing 122, portion or segment of the driveshaft housing 146. The second connecting feature 140 can be configured to engage the end 148 of the driveshaft housing 146 to secure the housing 122 to the drilling assembly 110, The second connecting feature 140 can be, for example, but not limited to, a second plurality of threads configured to threadedly engage a corresponding connecting feature, such as a plurality of threads defined by the end 148 of the driveshaft housing 146. The outer surface 142 of the housing 122 can be sized and shaped to correspond to the stator 116, the drilling assembly 110, or other existing external devices. For example, when the housing 122 is secured to the end 141 of the stator 116, the outer surface 142 of housing 122 can extend flush with an outer surface 144 of the stator 116 and an outer surface 150 of the driveshaft housing 146.

The housing 122 can include an inner surface 152. The inner surface 152 can define a first bore 154. In one non-limiting example, the first bore 154 can be a cylindrical bore extending longitudinally through the housing 122 between the first end 134 and the second end 136. The first bore 154 can define, or can otherwise extend along, the central axis A1. The first bearing 124 can extend radially inward from or be arranged on the inner surface 152 into the first bore 154. The first bearing 124 can define a first bearing surface 156. The first bearing surface 156 can be an innermost surface of the first bearing 124. In some non-limiting examples, the first bearing surface 156 can be coated, such as to reduce wear. For example, the first bearing surface 156 can be coated with, but not limited to, tungsten carbide, silicon carbide, or boron carbide. The first bearing surface 156 can define a first length L1. In one non-limiting example, the first length can be, but not limited to, between about 3 inches to about 5 inches, about 5 inches to about 7 inches, or about 7 inches to about 9 inches.

The first bearing 124 can be made from various materials. In some examples, the first bearing 124 can be made from a carbide material such as, but not limited to, tungsten carbide, silicon carbide, or boron carbide. In other examples, the first bearing 124 can be made from a coated or uncoated elastomeric or polymeric materials such as, but not limited to, nitrile butadiene rubber (NBR), hydrogenated nitrile butadiene rubber (HNBR), styrene butadiene rubber (SBR), fluoroelastomer (FKM, FPM), perfluoroelastomer (FFKM), polypropylene (PP), polyurethane (PU), polyethylene (RE), or phenolic. In still further examples, the first bearing 124 can be made from coated or uncoated metals, such as, but not limited to, steel or brass.

The shaft member 118 can include an outer surface 158, a proximal portion 160, and a distal portion 162. The outer surface 158 can extend between the proximal portion 160 and the distal portion 162. The outer surface 158 can generally form, but is not limited to, a cylindrical shape. The proximal portion 160 and the distal portion 162 can be generally opposite ends or segments of the shaft member 118. In some non-limiting examples, the proximal portion 160 can extend proximally beyond the first end 134 of the housing 122 and the distal portion 162 can extend distally beyond the second end 136 of the housing 122, In other non-limiting examples, the proximal portion 160 can extend proximally up to the first end 134 of the housing 122 and the distal portion 162 can extend distally up to the second end 136 of the housing 122. The second bearing 126 can extend radially outward from the outer surface 158 of the shaft member 118.

The second bearing 126 can define a second bearing surface 164. The second bearing surface 164 can be an outer-most surface of the second bearing 126. The second bearing 126 can be positioned proximally or distally along the outer surface 158 to correspond to a location of the first bearing 124 within the first bore 154. For example, when the shaft member 118 inserted into, or is encompassed by, the housing 122, the first bearing surface 156 can be in contact with the second bearing surface 164. In some non-limiting examples, the second bearing surface 164 can be coated, such as to reduce wear. For example, the second bearing surface 164 can be coated with, but not limited to, tungsten carbide, silicon carbide, or boron carbide.

The first bearing surface 156 can be configured to contact and engage the second bearing surface 164. For example, the first bearing 124 can sized and shaped to extend inwardly from the inner surface 152 by a distance sufficient to limit lateral movement between the first bearing surface 156 and the second bearing surface 164 when the shaft member 118 inserted into, or is encompassed by, the housing 122. In one non-limiting example, such a distance can be sufficient to limit the maximum clearance between a portion of the first bearing surface 156 and a portion of the second bearing surface 164, during rotation of the shaft member 118, to between, but not limited, about inch or about 0.5-1 inch. The second bearing 126 can be positioned proximally or distally along the outer surface 158 to correspond to a location of the first bearing 124 within the first bore 154. For example, when the shaft member 118 inserted into, or is encompassed by, the housing 122, the first bearing surface 156 can be in contact with the second bearing surface 164.

The second bearing surface 164 can define a second length L2. The second length L2 can be greater than or less than the first length L1 defined by the first bearing surface 156, such as depending on the material of the first bearing 124 and the second bearing 126. For example, if the first bearing 124 is made from metal, or carbide material, the first length L1 can be greater than the second length L2. Conversely, if the first bearing 124 is made from an elastomeric or polymeric material and the second bearing 126 is made from metal or a carbide material, the first length L1 can be less than the second length L2. This can ensure the first bearing surface 156 only contacts the second bearing surface 164 during rotation of the shaft member 118 when the first bearing 124 is less wear-resistant than the second bearing 126; and that the second bearing surface 164 only contacts the first bearing surface 156 when the second bearing 126 is less wear-resistant than the first bearing surface 156.

In one non-limiting example, the second bearing 126 can be coated portion of the outer surface 158. For example, such a coating can be, but is not limited to, tungsten carbide. The second bearing 126 can be made from various materials. The second bearing 126 can be made from various materials. In some examples, the second bearing 126 can be made from a coated or uncoated carbide material such as, but not limited to, tungsten carbide, silicon carbide, or boron carbide. In other examples, the second bearing 126 can be made from a coated or uncoated elastomeric or polymeric materials such as, but not limited to, nitrile butadiene rubber (NBR), hydrogenated nitrile butadiene rubber (HNBR), styrene butadiene rubber (SBR), fluoroelastomer (FKM, FPM), perfluoroelastomer (FFKM), polypropylene (PP), polyurethane (Pt), polyethylene (PE), or phenolic. In still further examples, the second bearing 126 can be made from coated or uncoated metals, such as, but not limited to, steel or brass. In one non-limiting example, the first bearing 124 can be made from a carbide-coated metal and the second bearing 126 can be made from an elastomeric or polymeric material. In another non-limiting example, the first bearing 124 and the second bearing 126 can be made from an elastomeric or polymeric material.

The proximal portion 160 of the shaft member can define or can include a first coupler 166. The first coupler 166 can be a proximal-most portion or end of the shaft member 118. The rotor 114 of the progressing cavity machine 108 can include a rotor head 168. The rotor head 168 can be a distal-most portion or segment of the rotor 114. The first coupler 166 can be configured to extend into, or otherwise engage, the rotor head 168 of the rotor 114 to secure the shaft member 118 to the rotor 114. The distal portion 162 of the shaft member 118 can define or can include a second coupler 170. The second coupler 170 can be a distal-most portion or end of the shaft member 118. The second coupler 170 can be configured to receive, or otherwise engage with, a portion of the driveshaft 120 to secure the shaft member 118 to the driveshaft 120. In one non-limiting example, the first coupler 166 can define a first plurality of threads configured to threadedly engage a second plurality of threads defined by the second coupler 170 to secure the shaft member 118 to the driveshaft 120.

Figure 3A:
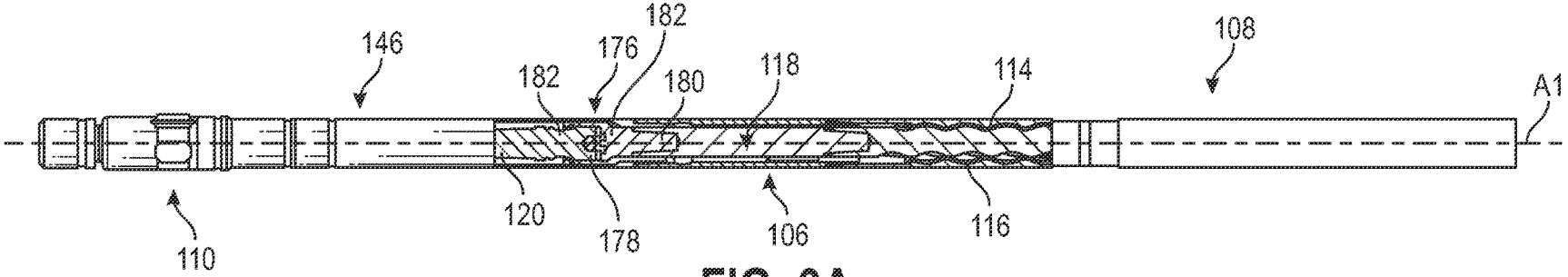
FIGS. 3A-3C illustrate cross-section views of a rotor bearing system coupling a progressive cavity machine to a drilling assembly.
Figure 3B:
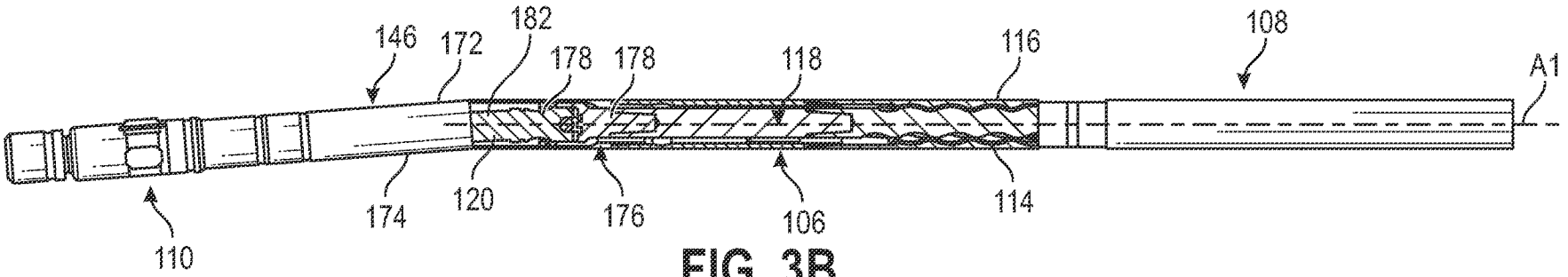
Figure 3C:
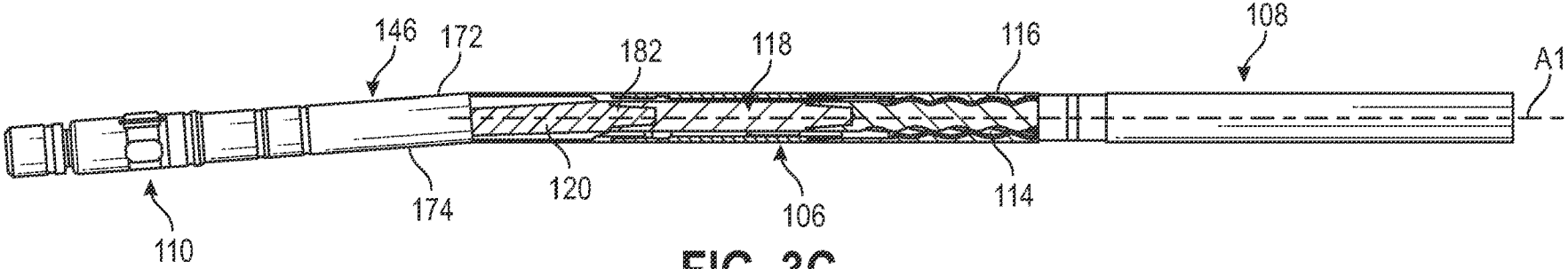

FIGS. 3A-3C illustrate cross-section views of a rotor bearing system 106 coupling a progressing cavity machine 108 to a drilling assembly 110. FIGS. 3A-3C are discussed below concurrently with reference to the rotor bearing system 106, the progressing cavity machine 108, and the drilling assembly 110 shown in FIGS. 1-2 above. In one non-limiting example, such as shown in FIG. 3A, the driveshaft housing 146 of the drilling assembly 110 can extend along the central axis A1. In other non-limiting examples, such as shown in FIGS. 3B-3C, the driveshaft housing 146 can extend at least partially at an angle relative to the central axis A1. For example, the driveshaft housing 146 can include a first portion 172 (FIGS. 3B-3C) and a second portion 174 (FIGS. 3B-3C). The first portion 172 can extend along the central axis A1. The second portion 174 can extend at an angle relative to the central axis A1.

For example, the second portion 174 can extend at, but not limited to, about one degree to about three degrees, about three degrees to about six degrees, or about six degrees to about ten degrees relative to the central axis A1. In some non-limiting examples, the driveshaft 120 can be a rigid driveshaft including a universal joint 176 (FIGS. 3A-3B). The universal joint 176 can include a first joint 178 (FIGS. 3A-3B) and a second joint 180 (FIGS. 3A-3B). The first joint 178 can be coupled to, or can be defined by, an end 182 of the driveshaft 120. The end 182 can be proximal-most portion of the driveshaft 120. The second joint 180 can be connected to the first joint 178 and extend proximally therefrom. The second coupler 170 of the shaft member 118 can be configured to receive the second joint 180 to secure the shaft member 118 to the driveshaft 120. In other non-limiting examples, the driveshaft 120 can be a flexible driveshaft. In such examples, the second coupler 170 can be configured to receive the end 182 of the driveshaft 120 to secure the shaft member 118 to the driveshaft 120.

Figure 4:
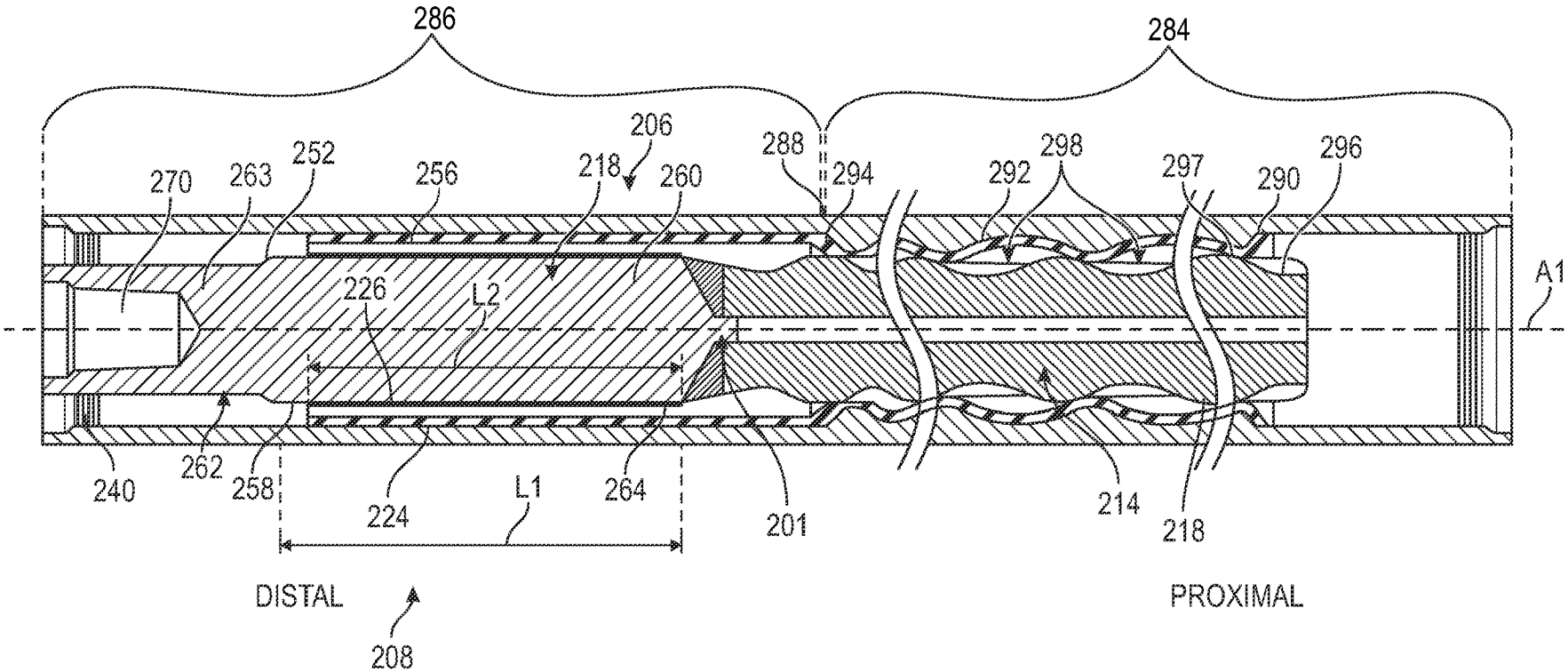
FIG. 4 illustrates a cross-section view of a progressing cavity machine including a rotor bearing system.

FIG. 4 illustrates a cross-section view of a progressing cavity machine 208 including a rotor bearing system 206. Also shown in FIG. 4 is a central axis A1, and orientation indicators Proximal and Distal. In contrast to the progressing cavity machine 108 shown in FIGS. 1-3C above, the progressing cavity machine 208 can include the rotor bearing system 206. The progressing cavity machine 208 can include a housing 200. The housing 200 can include a stator portion 284 and a bearing portion 286. The stator portion 284 can be similar to the stator 116 (FIGS. 1-2) and the bearing portion 286 can be similar to the housing 122 (FIGS. 1-2), at least in that the housing 122 can include a first bearing 224 and a second bearing 226.

The stator portion 284 and the bearing portion 286 can collectively define an outer surface 288. The outer surface 288 can form various three-dimensional shapes, such as but not limited to, a cylinder. The housing 200 can define a connecting feature 240. The connecting feature 240 can be configured to engage the end 148 (FIG. 2) of the driveshaft housing 146 (FIGS. 2-3C) to secure the housing 200 to the drilling assembly 110 (FIGS. 1-3C), or to other external devices. The connecting feature 240 can be, for example, but not limited to, a plurality of threads configured to threadedly engage a corresponding connecting feature, such as a plurality of threads defined by the end 148 (FIG. 2) of the driveshaft housing 146 (FIG. 2). The outer surface 288 of the housing 200 can be sized and shaped to correspond to the drilling assembly 110. For example, when the housing 200 is secured to the end 148 (FIG. 2) of the driveshaft housing 146, the outer surface 288 can extend flush with the outer surface 150.

The stator portion 284 can include an inner surface 290. The inner surface 290 can define a plurality of internal lobes 292. The bearing portion 286 of the housing 200 can include an inner surface 252. The housing 200 can include a stator liner 294. The stator liner 294 can be a sealing material, such as an elastomeric material, and can extend along the inner surface 252 of the stator portion 284 and at least partially along the inner surface 252 of the bearing portion 286. The stator liner 294 can define the first bearing 224 and a first bearing surface 256 thereof. The first bearing surface 256 can be a portion of the stator liner 294 in contact with the second bearing 226. In one non-limiting example, the first bearing surface 256 can be coated to reduce wear. For example, such a coating can be, but is not limited to, tungsten carbide. The stator liner 294 can be recessed into bearing portion 286 of the housing 200, such that inner surface 252 of the bearing portion 286 extends flush with the first bearing surface 256. The progressing cavity machine 208 can include a shaft member 201. The shaft member 201 can include a rotor portion 214 and a cylindrical portion 218. The rotor portion 214 can be formed integrally with the cylindrical portion 218. The rotor portion 214 can include an outer surface 296 defining a plurality of external lobes 297. The plurality of external lobes 297 can be sized and shaped to form a plurality of progressing cavities 298 via contact with the stator liner 294 of the plurality of internal lobes 292 during rotation of the shaft member 201.

The cylindrical portion 218 of the shaft member 201 can include an outer surface 258, a proximal portion 260, and a distal portion 262. The outer surface 258 can extend between the proximal portion 260 and the distal portion 262. The distal portion 262 can be, or can include, a rotor head 263. The rotor head 263 can be similar to the rotor head 168 (FIG. 2), at least in that the rotor head 263 can be a distal-most portion or segment of the shaft member 201. The outer surface 258 can generally form, but is not limited to, a cylindrical shape. The second bearing 226 can extend radially outward from the outer surface 258. The second bearing 226 can define a second bearing surface 264. The second bearing surface 264 can be an outer-most surface of the second bearing 226.

The second bearing surface 264 can define a second length L2. The second length L2 can be greater than or less than the first length L1 defined by the first bearing surface 256, such as depending on the material of the first bearing 224 and the second bearing 226. For example, if the first bearing 224 is made from metal, or carbide material, the first length L1 can be greater than the second length L2. Conversely, if the first bearing 224 is made from an elastomeric or polymeric material and the second bearing 226 is made from metal or a carbide material, the first length L1 can be less than the second length L2. This can ensure the first bearing surface 256 only contacts the second bearing surface 264 during rotation of the shaft member 201 when the first bearing 224 is less wear-resistant than the second bearing 226; and that the second bearing surface 264 only contacts the first bearing surface 256 when the second bearing 226 is less wear-resistant than the first bearing surface 256.

In one non-limiting example, the second bearing 226 can be a coated portion of the outer surface 258. For example, such a coating can be, but is not limited to, tungsten carbide, silicon carbide, or boron carbide. In another non-limiting example, the second bearing 226 can be made from various materials, such as, but not limited to, rubber or other elastomeric materials. The first bearing surface 256 can be configured to contact and engage the second bearing surface 264. The first bearing surface 256 and the second bearing surface 164 can be spaced apart by a distance sufficient to limit lateral movement between the first bearing surface 256 and the second bearing surface 264. The cylindrical portion 218 of the shaft member 201 can define or can include a coupler 270. The coupler 270 can be a distal-most portion or end of the shaft member 201. The second coupler 170 can be configured to receive, or otherwise engage with, a portion of the driveshaft 120 (FIGS. 1-3C) of the drilling assembly 110 (FIGS. 1-3C) to secure the shaft member 201 to the driveshaft 120.

Figure 5A:
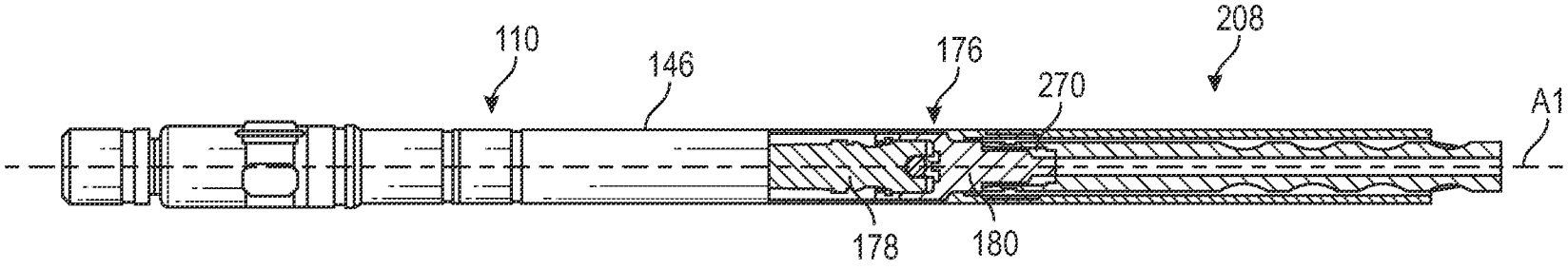
FIGS. 5A-5B illustrate cross-section views of a progressing cavity machine coupled to a drilling assembly.
Figure 5B:
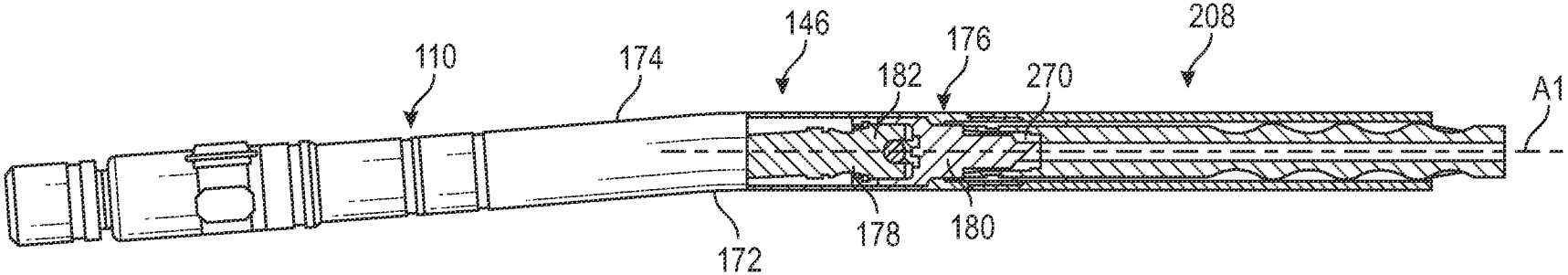

FIGS. 5A-5B illustrate cross-section views of a progressing cavity machine 208 cooped to a drilling assembly 110. FIGS. 5A-5B are discussed below concurrently with reference to the progressing cavity machine 208 shown in FIG. 4 and the drilling assembly 110 shown in FIGS. 1-3. In one non-limiting example, such as shown in FIG. the driveshaft housing 146 of the drilling assembly 110 can extend along the central axis A1. In other non-limiting examples, such as shown in FIG. 5B, the driveshaft housing 146 can extend at least partially at an angle relative to the central axis A1. For example, the driveshaft housing 146 can include the first portion 172 (FIG. 5B) and the second portion 174 (FIG. 5B).

The first portion 172 can extend along the central axis A1. The second portion 174 can extend at an angle relative to the central axis A1. For example, the second portion 174 can extend at, but not limited to, about one degree to about three degrees, about three degrees to about six degrees; or about six degrees to about ten degrees relative to the central axis A1, In some non-limiting examples, the driveshaft 120 can be a rigid driveshaft including the universal joint 176 (FIGS. 5A-5B). The universal joint 176 can include the first joint 178 (FIGS. 3A-3B) and the second joint 180 (FIGS. 3A-3B). The first joint 178 can be coupled to, or can be defined by, the end 182 of the driveshaft 120. The second joint 180 can be coupled to the first joint 178 and extend proximally therefrom. The coupler 270 of the cylindrical portion 218 of the shaft member 201 can be configured to receive the second joint 180 to secure the shaft member 201 to the driveshaft 120, In other non-limiting examples, the driveshaft 120 can be a flexible driveshaft. In such examples, the coupler 270 can be configured to receive the end 182 of the driveshaft 120 to secure the shaft member 201 to the driveshaft 120.

Figure 6:
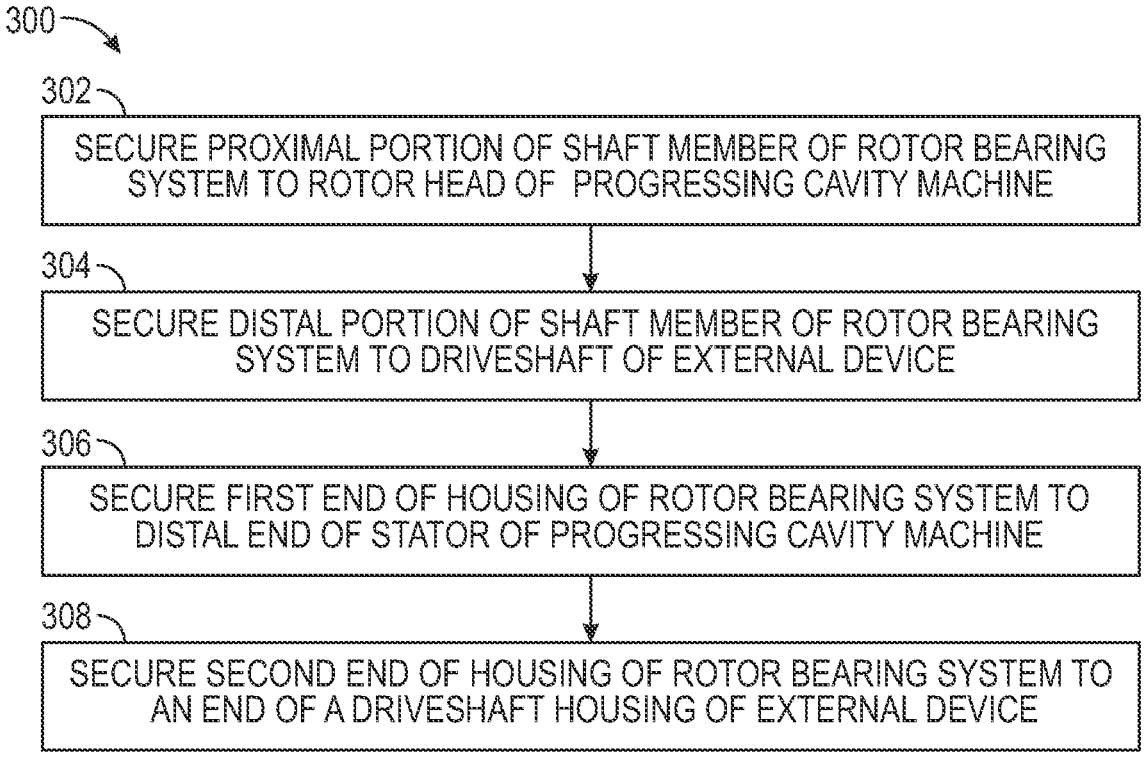
FIG. 6 illustrates a method of limiting eccentric motion of a rotor head of a progressing cavity machine and a driveshaft of an external device relative to a stator of the progressing cavity machine using a rotor bearing system.

FIG. 6 illustrates a method of limiting eccentric motion of a rotor head of a progressing cavity machine and a driveshaft of an external device relative to a stator of the progressing cavity machine using a rotor bearing system. Any of the above examples of the rotor bearing system 106 or 206 shown in, and described with regard to, FIGS. 1-5B above can be used in the method 300. The discussed steps or operations can be performed in parallel or in a different sequence without materially impacting other operations. The method 300 as discussed includes operations that can be performed by multiple different actors, devices, and/or systems. It is understood that subsets of the operations discussed in the method 300 can be attributable to a single actor device, or system, and could be considered a separate standalone process or method.

The method 300 can include operation 302. The operation 302 can include securing a proximal portion of a shaft member of the rotor bearing system to the rotor head of the progressing cavity machine. For example, a user can translate the shaft member proximally toward the rotor head to insert the proximal portion of the shaft member into the rotor head. The shaft member can be supported within a housing of the rotor bearing system by a first bearing and a second bearing located within the housing and in contact with each other to inhibit lateral movement of the shaft member, such as to thereby limit eccentric motion of the rotor head relative to the proximal portion of the shaft member.

In one non-limiting example, the operation 302 can include inserting a first coupler of the shaft member into the rotor head of the progressing cavity machine. For example, a user can insert a first coupler defined by, included on, or otherwise attached to, the proximal portion of the shaft member into the rotor head to secure the shaft member to the rotor of the progressing cavity machine.

The method 300 can include operation 304. The operation 304 can include securing a distal portion of the shaft member of the rotor bearing system of the rotor bearing system to the driveshaft of the external device. For example, a user can translate the driveshaft proximally toward the distal portion of the shaft member to insert an end of the driveshaft into the distal portion of the shaft member. The shaft member can be supported by the first bearing and the second bearing located within the housing and in contact with each other to inhibit lateral movement of the shaft member, such as to thereby limit eccentric motion of the end of the driveshaft relative to the distal portion of the shaft member.

In one non-limiting example, the operation 304 can include inserting an end of the driveshaft, or an input shaft of a universal joint extending from the proximal end of the driveshaft, into a second coupler of the shaft member. For example, the driveshaft can be a flexible driveshaft and the distal portion of the shaft member can define or include a second coupler defined by, included on, or otherwise attached to, the distal portion of the shaft member. In such an example, a user can insert the end of the driveshaft into the second coupler to secure the shaft member to the driveshaft of the external device. In an alternative example, the driveshaft can be a rigid driveshaft including a universal joint extending from the end of the driveshaft. In such an example, a user can insert a second joint of the universal joint into the second coupler to secure the shaft member to the driveshaft of the external device.

The method 300 can include operation 306. The operation 306 can include securing a first end of a housing of the rotor bearing system to a distal end of a stator of the progressing cavity machine. For example, the first end of the housing can define a first connecting feature configured to engage an end of the stator of the progressing cavity machine to secure the housing to the stator, such as to prevent vertical, lateral, or longitudinal movement therebetween. In one such example, a user can threadedly engage a plurality of threads of the first connecting feature with a plurality of threads of the end of the stator to secure the housing to the stator.

The method 300 can include operation 308. The operation 308 can include securing a second end of the housing of the rotor bearing system to the end of a driveshaft housing of the external device. For example, the second end of the housing can define a second connecting feature configured to engage the end of the driveshaft housing to secure the housing to the driveshaft housing, such as to prevent vertical, lateral, or longitudinal movement therebetween. In one such example, a user can threadedly engage a plurality of threads of the second connecting feature with a plurality of threads of the end of the driveshaft housing to secure the housing to the driveshaft housing.

The foregoing systems and devices, etc. are merely illustrative of the components, interconnections, communications, functions, etc. that can be employed in carrying out examples in accordance with this disclosure. Different types and combinations of sensor or other portable electronics devices, computers including clients and servers, implants, and other systems and devices can be employed in examples according to this disclosure.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided.

Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure.

This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

EXAMPLES

The following, non-limiting examples, detail certain aspects of the present subject matter to solve the challenges and provide the benefits discussed herein, among others.

Example 1 is a rotor bearing system configured to operatively couple a progressing cavity machine to an external device, the rotor bearing system comprising: a housing including: an inner surface defining a first bore extending through the housing along a central axis; a first bearing arranged on the inner surface; and a shaft member configured to connect a driveshaft of the external device to a rotor head of the progressing cavity machine, the shaft member including: an outer surface extending between a proximal portion and a distal portion of the shaft member; and a second bearing arranged on the outer surface, the second bearing configured to contact the first bearing to limit eccentric motion of the driveshaft of the external device and the rotor head of the progressing cavity machine relative to a stator of the progressing cavity machine during rotation of the rotor head, the shaft member, and the driveshaft.

In Example 2, the subject matter of Example 1 includes, wherein a proximal portion of the shaft member is configured to engage a rotor head of the progressing cavity machine to secure the shaft member to the rotor head; and wherein a distal portion of the shaft member is configured to engage a driveshaft of the external device to secure the shaft member to the driveshaft.

In Example 3, the subject matter of Example 2 includes, wherein the proximal portion of the shaft member defines a first coupler configured to extend into a receiver of the rotor head to secure the proximal portion to the rotor head, and wherein the distal portion of the shaft member defines a second coupler configured to receive a proximal end of the driveshaft, or an input shaft of a universal joint of the driveshaft, to secure the shaft member to the driveshaft.

In Example 4, the subject matter of Examples 1-3 includes; wherein a first end of the housing defines a first connecting feature configured to engage a stator of the progressing cavity machine to secure the housing to the stator; and wherein a second end of the housing defines a second connecting feature configured to engage a driveshaft housing of the external device to secure the housing to the driveshaft housing.

In Example 5, the subject matter of Example 4 includes, wherein the first connecting feature is a first plurality of threads configured to threadedly engage a plurality of threads defined by the stator; and wherein the second connecting feature is a second plurality of threads configured to threadedly engage a plurality of threads defined by the driveshaft housing.

In Example 6, the subject matter of Examples 4-5 includes, wherein the housing defines an outer surface extending between the first end and the second end; and wherein the outer surface extends flush with an outer surface of the stator and an outer surface of the driveshaft housing when the housing is secured to the stator and the driveshaft housing.

In Example 7, the subject matter of Examples 1-6 includes, wherein the first bearing is made from an elastomeric material and the second bearing is made from an elastomeric material.

In Example 8, the subject matter of Examples 1-7 includes, wherein the first bearing is made from an elastomeric material and the second bearing is made from a carbide material.

In Example 9, the subject matter of Example 8 includes, wherein the first bearing defines a first bearing surface and the second bearing defines a second bearing surface; and wherein the first bearing surface defines a first length that is less than a second length defined by the second bearing surface.

In Example 10, the subject matter of Example 9 includes, wherein at least one of the first bearing surface and the second bearing surface is coated to reduce wear.

In Example 11, the subject matter of Examples 1-10 includes, wherein the first bearing is made from a carbide material and the second bearing is made from an elastomeric material.

In Example 12, the subject matter of Example 11 includes, wherein the first bearing defines a first bearing surface and the second bearing defines a second bearing surface; and wherein the first bearing surface defines a first length that is greater than a second length defined by the second bearing surface.

In Example 13, the subject matter of Examples 1-12 includes, wherein the first bearing is made from an elastomeric material and the second bearing is made from metal.

Example 14 is a progressing cavity machine configured to provide rotational drive to an external device, the progressing cavity machine comprising: a housing comprising: a stator portion and a bearing portion collectively defining an outer surface, the stator portion including an inner surface defining a plurality of internal lobes and the bearing portion including an inner surface defining a first bearing; and a shaft member comprising: a rotor portion including: an outer surface defining a plurality of external lobes configured to form a plurality of progressing cavities via contact with the plurality of internal lobes during rotation of the shaft member; and a cylindrical portion including: a coupler configured to engage a driveshaft of the external device to secure a rotor head of the shaft member to the driveshaft; and a second bearing arranged on an outer surface of the cylindrical portion, the second bearing configured to contact the first bearing to limit eccentric motion of the driveshaft of the external device and the rotor head of the progressing cavity machine relative to the stator portion of the progressing cavity machine during rotation of the rotor head, the shaft member, and the driveshaft.

In Example 15, the subject matter of Example 14 includes, wherein the housing defines a connecting feature configured to engage a driveshaft housing of the external device to secure the housing to the driveshaft housing.

In Example 16, the subject matter of Examples 14-15 includes, wherein the first bearing is formed integrally with a stator liner located between the plurality of external lobes and the plurality of internal lobes.

In Example 17, the subject matter of Example 16 includes, wherein the first bearing is made from an elastomeric material and the second bearing is made from an elastomeric material.

In Example 18, the subject matter of Examples 16-17 includes, wherein the first bearing is made from an elastomeric material and the second bearing is made from a carbide material; and wherein at least one of the first bearing and the second bearing is coated to reduce wear.

In Example 19, the subject matter of Example 18 includes, wherein the first bearing defines a first bearing surface and the second bearing defines a second bearing surface; and wherein the first bearing surface defines a first length that is less than a second length defined by the second bearing surface.

In Example 20, the subject matter of Examples 14-19 includes, wherein the first bearing is made from a carbide material and the second bearing is made from an elastomeric material; and wherein at least one of the first bearing and the second bearing is coated to reduce wear.

In Example 21, the subject matter of Example 20 includes, wherein the first bearing defines a first bearing surface and the second bearing defines a second bearing surface; and wherein the first bearing surface defines a first length that is greater than a second length defined by the second bearing surface.

In Example 22, the subject matter of Examples 1-21 includes, wherein the first bearing is made from an elastomeric material and the second bearing is made from metal.

Example 23 is a method of limiting eccentric motion of a rotor head of a progressing cavity machine and a driveshaft of an external device relative to a stator of the progressing cavity machine using a rotor bearing system, the method comprising: securing a proximal portion of a shaft member of the rotor bearing system to the rotor head of the progressing cavity machine; and securing a distal portion of the shaft member of the rotor bearing system of the rotor bearing system to the driveshaft of the external device.

In Example 24, the subject matter of Example 23 includes, wherein the method further includes securing a first end of a housing of the rotor bearing system to an end of a stator of the progressing cavity machine.

In Example 25, the subject matter of Example 24 includes, wherein the method further includes securing a second end of the housing of the rotor bearing system to an end of a driveshaft housing of the external device.

In Example 26, the subject matter of Example 25 includes, wherein securing the first end of the housing of the rotor bearing system includes threadedly engaging the end of the stator with the first end of the housing; and wherein securing the second end of the housing of the rotor bearing system includes threadedly engaging the end of the driveshaft housing with the second end of the housing.

In Example 27, the subject matter of Examples 23-26 includes, wherein securing the proximal portion of the shaft member of the rotor bearing system to the rotor head of the progressing cavity machine includes inserting a first coupler of the shaft member into the rotor head of the progressing cavity machine.

In Example 28, the subject matter of Example 27 includes, wherein securing the distal portion of the shaft member of the rotor bearing system to the driveshaft of the external device includes inserting a proximal end of the driveshaft, or a second joint of a universal joint extending from the end of the driveshaft, into a second coupler of the shaft member.

Example 29 is at least one machine-readable medium including instructions that, when executed by processing circuitry, cause the processing circuitry to perform operations to implement of any of Examples 1-28.

Example 30 is an apparatus comprising means to implement of any of Examples 1-28.

Example 31 is a system to implement of any of Examples 1-28, Example 32 is a method to implement of any of Examples 1-28.

What is claimed is:

1. An external bearing system configured to operatively couple a progressing cavity machine, having a stator and a rotor with a cylindrical rotor head, to an external device, having a driveshaft and a driveshaft housing, the external bearing system comprising:

a housing including:

an inner surface defining a first bore extending through the housing along a central axis; and a first bearing arranged on the inner surface; and a continuous shaft member configured to connect a driveshaft of the external device to the cylindrical rotor head of the progressing cavity machine, the continuous shaft member including:

an outer surface extending between a proximal portion and a distal portion of the shaft member; and a second bearing arranged on the outer surface, the second bearing configured to contact the first bearing to limit eccentric motion of the driveshaft of the external device and the cylindrical rotor head of the progressing cavity machine relative to a stator of the progressing cavity machine during rotation of the rotor head, the shaft member, and the driveshaft, wherein, when operatively coupled to the progressive cavity machine, the first bearing and the second bearing are external to the stator of the progressive cavity machine and are spaced longitudinally away from the cylindrical rotor head of the rotor.

2. The external bearing system of claim 1, wherein a proximal portion of the continuous shaft member is configured to engage the cylindrical rotor head of the progressing cavity machine to secure the continuous shaft member to the cylindrical rotor head; and wherein a distal portion of the continuous shaft member is configured to engage a driveshaft of the external device to secure the continuous shaft member to the driveshaft.

3. The external bearing system of claim 2, wherein the proximal portion of the continuous shaft member defines a first coupler configured to extend into a receiver of the cylindrical rotor head to secure the proximal portion to the cylindrical rotor head, and wherein the distal portion of the continuous shaft member defines a second coupler configured to receive a proximal end of the driveshaft, or an input shaft of a universal joint of the driveshaft, to secure the continuous shaft member to the driveshaft.

4. The external bearing system of claim 1, wherein a first end of the housing defines a first connecting feature configured to engage a stator of the progressing cavity machine to secure the housing to the stator; and wherein a second end of the housing defines a second connecting feature configured to engage a driveshaft housing of the external device to secure the housing to the driveshaft housing.

5. The external bearing system of claim 4, wherein the first connecting feature is a first plurality of threads configured to threadedly engage a plurality of threads defined by the stator; and wherein the second connecting feature is a second plurality of threads configured to threadedly engage a plurality of threads defined by the driveshaft housing.

6. The external bearing system of claim 4, wherein the housing defines an outer surface extending between the first end and the second end; and wherein the outer surface extends flush with an outer surface of the stator and an outer surface of the driveshaft housing when the housing is secured to the stator and the driveshaft housing.

7. The external bearing system of claim 1, wherein the first bearing is made from an elastomeric material and the second bearing is made from an elastomeric material.

8. The external bearing system of claim 1, wherein the first bearing is made from an elastomeric material and the second bearing is made from a carbide material.

9. The external bearing system of claim 8, wherein the first bearing defines a first bearing surface and the second bearing defines a second bearing surface; and wherein the first bearing surface defines a first length that is less than a second length defined by the second bearing surface.

10. The external bearing system of claim 9, wherein at least one of the first bearing surface and the second bearing surface is coated to reduce wear.

11. The external bearing system of claim 1, wherein the first bearing is made from a carbide material and the second bearing is made from an elastomeric material.

12. The external bearing system of claim 11, wherein the first bearing defines a first bearing surface and the second bearing defines a second bearing surface; and wherein the first bearing surface defines a first length that is greater than a second length defined by the second bearing surface.

13. The external bearing system of claim 1, wherein the first bearing is made from an elastomeric material and the second bearing is made from metal.

14. A method of limiting eccentric motion of a cylindrical rotor head of a progressing cavity machine and a driveshaft of an external device relative to a stator of the progressing cavity machine using an external bearing system, the method comprising:

securing a proximal portion of a shaft member of the external bearing system to the cylindrical rotor head of the progressing cavity machine;

securing a distal portion of the shaft member of the external bearing system of the rotor bearing system to the driveshaft of the external device;

securing a first end of a housing of the external bearing system to an end of the stator of the progressing cavity machine;

securing a second end of the housing to an end of a drive shaft housing of the external device; and managing eccentric motion of the cylindrical rotor head with a bearing arranged between the shaft member and the housing of the external bearing system.

15. The method of claim 14, wherein securing the first end of the housing of the external bearing system includes threadedly engaging the end of the stator with the first end of the housing; and wherein securing the second end of the housing of the external bearing system includes threadedly engaging the end of the driveshaft housing with the second end of the housing.

16. The method of claim 14, wherein securing the proximal portion of the shaft member of the external bearing system to the cylindrical rotor head of the progressing cavity machine includes inserting a first coupler of the shaft member into the cylindrical rotor head of the progressing cavity machine.

17. The method of claim 16, wherein securing the distal portion of the shaft member of the external bearing system to the driveshaft of the external device includes inserting a proximal end of the driveshaft, or a second joint of a universal joint extending from the end of the driveshaft, into a second coupler of the shaft member.

18. A system for managing eccentric motion of a progressive cavity machine, comprising:

a progressive cavity machine having a stator and a rotor arranged within the stator, the rotor having a helical portion and a cylindrical rotor head;

an external bearing system comprising:

a housing including:

an inner surface defining a first bore extending through the housing along a central axis; and a first bearing arranged on the inner surface; and a continuous shaft member configured to connect a driveshaft of an external device to the cylindrical rotor head of the progressing cavity machine, the continuous shaft member including:

an outer surface extending between a proximal portion and a distal portion of the shaft member; and a second bearing arranged on the outer surface, the second bearing configured to contact the first bearing to limit eccentric motion of the driveshaft of the external device and the cylindrical rotor head of the progressing cavity machine relative to the stator of the progressing cavity machine during rotation of the rotor head, the shaft member, and the driveshaft.

* * * * *